US008192553B2

(12) United States Patent
Snodgrass et al.

(10) Patent No.: US 8,192,553 B2
(45) Date of Patent: Jun. 5, 2012

(54) POT AND PAN SOAKING COMPOSITION

(75) Inventors: Edward J. Snodgrass, Inver Grove Heights, MN (US); Jaclyn J. Steep, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 225 days.

(21) Appl. No.: 12/787,952

(22) Filed: May 26, 2010

(65) Prior Publication Data

US 2010/0300493 A1 Dec. 2, 2010

Related U.S. Application Data

(60) Provisional application No. 61/181,063, filed on May 26, 2009.

(51) Int. Cl.
*B08B 3/04* (2006.01)

(52) U.S. Cl. ..... 134/26; 134/25.2; 134/25.3; 134/34; 134/36; 134/42; 510/220; 510/224; 510/225; 510/445; 510/477; 510/478

(58) Field of Classification Search ..... 510/220, 510/224, 225, 445, 477, 478; 134/25.2, 25.3, 134/26, 34, 36, 42
See application file for complete search history.

(56) References Cited

U.S. PATENT DOCUMENTS

| | | | | |
|---|---|---|---|---|
| 4,595,520 | A | 6/1986 | Heile et al. | |
| 4,680,134 | A | 7/1987 | Heile et al. | |
| 4,689,167 | A | 8/1987 | Collins et al. | |
| RE32,818 | E | 1/1989 | Fernholz et al. | |
| 4,830,773 | A | 5/1989 | Olson | |
| 4,971,714 | A | 11/1990 | Lokkesmoe et al. | |
| 5,009,804 | A | 4/1991 | Clayton et al. | |
| 6,150,324 | A | 11/2000 | Lentsch et al. | |
| 6,156,715 | A | 12/2000 | Lentsch et al. | |
| 6,177,392 | B1 | 1/2001 | Lentsch et al. | |
| 6,191,088 | B1 * | 2/2001 | Binstock et al. | 510/224 |
| 6,258,765 | B1 | 7/2001 | Wei et al. | |
| 6,410,495 | B1 | 6/2002 | Lentsch et al. | |
| 6,583,094 | B1 | 6/2003 | Lentsch et al. | |
| 6,638,902 | B2 | 10/2003 | Tarara et al. | |
| 6,653,266 | B2 | 11/2003 | Wei et al. | |
| 6,660,707 | B2 | 12/2003 | Lentsch et al. | |
| 6,831,054 | B2 | 12/2004 | Lentsch et al. | |
| 6,956,019 | B2 | 10/2005 | Lentsch et al. | |
| 7,087,569 | B2 | 8/2006 | Lentsch et al. | |
| 7,094,746 | B2 | 8/2006 | Lentsch et al. | |
| 7,424,891 | B2 * | 9/2008 | Gentschev et al. | 134/25.2 |
| 2008/0274942 | A1 * | 11/2008 | Tjelta et al. | 510/445 |
| 2009/0011973 | A1 * | 1/2009 | Besse et al. | 510/445 |
| 2009/0105114 | A1 * | 4/2009 | Stolte et al. | 510/446 |
| 2009/0176687 | A1 * | 7/2009 | Tjelta et al. | 510/445 |

* cited by examiner

*Primary Examiner* — Bibi Carrillo
(74) *Attorney, Agent, or Firm* — Andrew D. Sorensen; Shaoni L. Mitchell

(57) ABSTRACT

A soaking composition including an alkalinity source, a metal protector, a surfactant, water, a threshold agent, a binding agent, and a polymer blend that functions as a binding agent and a hard water modifier. The polymer blend includes a polymaleic acid, a polycarboxylic acid and a sodium polyacrylate.

4 Claims, No Drawings

POT AND PAN SOAKING COMPOSITION

CROSS-REFERENCE TO RELATED APPLICATION

This application claims the benefit under 35 U.S.C §119 of U.S. Provisional Application No. 61/181,063, filed on May 26, 2009, entitled "Pot and Pan Soaking Composition" which is herein incorporated by reference in its entirety.

TECHNICAL FIELD

The present invention relates to the field of soaking compositions. In particular, the present invention relates to a pot and pan soaking composition.

BACKGROUND

Heavily soiled wares can require multiple cleaning steps to remove the soils from the surfaces of the wares. Pots and pans used for prepping, cooking, and baking ware in full service restaurants can be particularly difficult to clean in a dishmachine due to the caramelized soil baked on to the surface of the ware. Some full service restaurants have attempted to overcome this issue by using, as a pre-step to washing the pots and pans in the dishmachine, a 3-compartment sink for soaking the pots and pans. Exemplary soaking solutions include water, pot and pan detergent solutions, or silverware presoaks. While these presoaks do loosen the greasy, caramelized soils from the ware such that the soils are more easily removed once the pots or pans are washed in the dishmachine, more than one wash is still typically required to completely clean the ware even with this extra soaking step.

Washing pots and pans in the dishmachine can also lead to ware compatibility issues. Most dishmachine detergents are highly alkaline and may corrode or discolor metals, such as aluminum, when introduced into the dishmachine. Water and pot and pan detergents can also lead to discoloration of aluminum if the soaking occurs for a long period of time at higher temperatures. Also, when ware is soaked in a solution and then removed and placed into the dishmachine, a small quantity of the soaking solution is typically carried with the ware into the dishmachine. This can cause compatibility issues because components in the soaking composition may effect the cleaning process in the dishmachine. For example, if the detergent is carried over in significant quantities into the dishmachine sump, the components can lead to foaming in the dishmachine and pump.

A one-pass warewashing process would reduce the amount of water, electricity, and detergent required.

SUMMARY

In one embodiment, the present invention is a solid soaking composition including an alkalinity source, a metal protector, a surfactant system, water, a threshold agent, a binding agent, and a polymer blend that functions as a binding agent and a hard water modifier. The polymer blend includes a polymaleic acid, a polycarboxylic acid and a sodium polyacrylate.

In another embodiment, the present invention is a presoak composition including between about 30% and about 80% by weight alkalinity source, between about 15% and about 35% by weight metal protector, between about 2% and about 10% by weight surfactant, between about 5% and about 20% by weight water, between about 0.2% and about 2% by weight threshold agent, between about 2% and about 8% by weight binding agent, and a polymer blend that functions as a binding agent and a hard water modifier. The polymer blend includes between about 0.5% and about 5% by weight of each of the polymers in the polymer blend.

In yet another embodiment, the present invention is a method of removing heavily soiled surfaces from a substrate. The method includes forming a composition having degreasing and metal protecting properties and contacting the surface of the substrate with the composition. The composition includes an alkalinity source, a metal protector, a surfactant system, water, a threshold agent, a binding agent, and a polymer blend that functions as a binding agent and a hard water modifier.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Soaking Composition

The present invention relates to a soaking composition and methods of using the soaking composition to remove grease and food soils from surfaces without significant corrosive or detrimental effects on the aesthetics of such surfaces. In addition to loosening greasy, baked on soils, the soaking solution also protects the surface of the ware both while soaking in the soaking composition and while passing through a dishmachine. Moreover, the soaking composition is low foaming to allow compatibility with a dishmachine and does not irritate skin. The soaking composition is used to loosen grease and food soils on ware, such as pots and pans, before the pots and pans are run through a dishmachine. The soaking step reduces the number of washes soiled ware must undergo to remove the soils when compared to not using a soaking composition, soaking with water, or soaking with a manual detergent. In one embodiment, the soaking composition is substantially free of phosphoric acid. The soaking composition can be used on ware made of various materials, including, for example: stainless steel, aluminum, cast iron and plastics. A particularly suitable application for the soaking composition is removing grease and organic soils from pots and pans.

The soaking composition loosens grease and soil from the surface such that the soil is substantially removed from the surface when the ware is passed through a single cycle of a dishmachine. In addition, no personal protective equipment is needed when the soaking composition is used at the recommended concentration and with the recommended procedures.

The soaking composition provides metal protection for metal ware and prevents discoloration when soaked in the soaking composition for extended soak times at the recommended detergent concentration. Ware immersed in the soaking composition can soak overnight with minimal to no discoloration. For example, Aluminum 3003 and 60611 can be soaked in the soaking solution for extended soak times at the recommended detergent concentration without causing noticeable blackening or discoloration.

Typically, when ware is soaked in a solution and then removed and placed into a dishmachine, a small quantity of the soaking solution is carried with the ware. Because the soaking composition is used prior to placing the ware in a dishmachine for cleaning, components in the soaking composition may produce foam. The soaking composition is formulated to produce lower foam than typical pot and pan detergents when agitated. This lower foaming property allows the soaking composition to be used in combination with a dishmachine without excessive carryover.

The soaking composition can be provided in solid or liquid form and includes an alkalinity source, a metal protector, a surfactant or surfactant system, water, a threshold agent, a binding agent and a polymer blend that functions as a binding agent and a hard water modifier. When provided as a solid composition, the soaking composition includes, in concentrate form, between about 30% and about 80% by weight alkalinity source, between about 15% and about 35% by weight metal protector, between about 2% and about 10% by weight surfactant, between about 5% and about 20% by weight water, between about 0.2% and about 2% by weight threshold agent, between about 2% and about 8% by weight binding agent, and between about 0.5% and about 5% by weight of each of the polymers in the polymer blend. Particularly, the solid soaking composition includes between about 40% and about 70% by weight alkalinity source, between about 18% and about 30% by weight metal protector, between about 4% and about 8% by weight surfactant, between about 5% and about 10% by weight water, between about 0.4% and about 1% by weight threshold agent, between about 2% and about 5% by weight binding agent, and between about 1% and about 3% by weight of each of the polymers in the polymer blend. In other embodiments, similar intermediate concentrations and use concentrations may also be present in the soaking compositions of the invention.

When provided as a liquid composition, the soaking composition includes an increased amount of water. In one embodiment, the liquid soaking composition includes between about 40% and about 70% water and particularly between about 50% and about 70% water.

The soaking composition of the present invention includes a polymer blend that functions as both a binding agent and a hard water modifier. In one embodiment, the polymer blend includes a polymaleic acid, a polycarboxylic acid and a sodium polyacrylate. An example of a suitable polymaleic acid includes, but is not limited to, a polymaleic acid that is 50% solids with a viscosity of between about 40 and about 50 centipoise (cP) at about 25° C. An example of a commercially suitable polymaleic acid includes, but is not limited to, Belclene 200, available from Houghton Chemical Corporation, Boston, Mass. An example of a suitable polycarboxylic acid includes, but is not limited to, a polycarboxylic acid that is 45% solids with a viscosity of between about 400 and about 1400 cP at about 25° C. An example of a commercially suitable polycarboxylic acid includes, but is not limited to, Acusol 929, available from Rohm & Haas, Cincinnati, Ohio. An example of a suitable sodium polyacrylate includes, but is not limited to, a sodium polyacrylate that is 45% solids with a viscosity of between about 600 and about 1200 cP at about 25° C. An example of a commercially suitable sodium polyacrylate includes, but is not limited to, Acusol 445 N, available from Rohm & Haas.

An exemplary formulation parameter of the invention is that the soaking composition includes the polymers in the polymer blend at various ratios. In one embodiment, the polymers in the polymer blend are present at a ratio of between about 4:1:1 and about 1:1:4. In another embodiment, the polymers in the polymer blend are present at a ratio of between about 3:2:1 and about 1:2:3. In yet another embodiment, the polymers in the polymer blend are present at a ratio of about 1:1:1.

The alkalinity source of the soaking composition can include, for example, an alkali metal hydroxide, alkali metal carbonate, or alkali metal silicate. Examples of suitable alkalinity sources include, but are not limited to: sodium hydroxide, potassium hydroxide, sodium carbonate, potassium carbonate or a mixture of alkali metal sodium hydroxide and alkali metal carbonate. The alkalinity source controls the pH of the resulting solution when water is added to the detergent composition to form a use solution. The pH of the use solution must be maintained in the alkaline range in order to provide sufficient detergency properties. In one embodiment, the pH of the use solution is between approximately 9 and approximately 12. Particularly, the pH of the use solution is about 10. If the pH of the use solution is too low, for example, below approximately 9, the use solution may not provide adequate detergency properties. If the pH of the use solution is too high, for example, above approximately 13, the use solution may be too alkaline and attack or damage the surface to be cleaned.

The alkalinity source may also function as a hydratable salt to form the solid cast. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. There is no requirement that the hydratable component be completely anhydrous.

The soaking composition of the present invention includes a metal protector or corrosion inhibitor such that the soaking composition is safe to use with metals. For example, the soaking composition is safe to use on aluminum-based products. Examples of suitable metal protectors include, but are not limited to, a combination of a source of aluminum ion and a source of zinc ion, as well as an alkaline metal silicate or hydrate thereof. An example of a particularly suitable metal protector includes, but is not limited to, sodium silicate. Exemplary metals that can be used with the soaking composition include Aluminum 3003 and Aluminum 6061.

The soaking composition also includes a surfactant or surfactant system. The surfactant or surfactant system of the soaking composition functions to degrease, emulsify and penetrate the soils. The surfactant or surfactant system may include anionic, nonionic, cationic, and zwitterionic surfactants. Because the soaking composition is intended to be used in an automatic dishwashing or warewashing machine, the surfactants selected are those that provide an acceptable level of foaming when used inside a dishwashing or warewashing machine. Low foaming surfactants that provide the desired level of detersive activity are advantageous in environments where the presence of large amounts of foaming can be problematic, such as in a dishwashing machine. Accordingly, surfactants that are considered low foaming surfactants can be used. In addition, other surfactants can be used in conjunction with a defoaming agent to control the level of foaming. For a discussion of surfactants, see Kirk-Othmer, Encyclopedia of Chemical Technology, Third Edition, volume 8, pages 900-912, which is incorporated herein by reference.

In one embodiment, the surfactant system includes low foaming, nonionic surfactants such that the soaking composition is dishmachine compatible. Examples of suitable nonionic surfactants include, for example, an alcohol ethoxylate made from a $C_{11}$ linear alcohol with 3 moles ethylene oxide and a 7 mole ethoxylate of a linear, primary $C_{12-14}$ alcohol. Examples of commercially available nonionic surfactants include, but are not limited to: Tomadol 1-3 available from Air Products (formerly Tomah Products), Milton, Wis. and Surfonic L24-7, available from Huntsman Performance Products, The Woodlands, Tex.

Water may be independently added to the soaking composition or may be provided as a result of its presence in an aqueous material that is added to the soaking composition. For example, materials added to the soaking composition may include water or may be prepared in an aqueous premix available for reaction with the soaking composition component(s). Typically, water is introduced into the soaking composition to provide the soaking composition with a desired viscosity for processing prior to solidification and to provide a desired rate of solidification. The water may also be present as a processing aid and may be removed or become water of hydration. The water may thus be present in the form of aqueous solutions of the soaking composition, or aqueous solutions of any of the other ingredients, and/or added aqueous medium as an aid in processing. In addition, it is expected that the aqueous medium may help in the solidification process when it is desired to form the concentrate as a solid. The water may also be provided as deionized water or as softened water.

The amount of water in the resulting solid soaking composition will depend on whether the solid soaking composition is processed through forming techniques or casting (solidification occurring within a container) techniques. In general, when the components are processed by forming techniques, it is believed that the solid soaking composition can include a relatively smaller amount of water for solidification compared with the casting techniques. When preparing the solid soaking composition by forming techniques, water may be present in ranges of between about 5% and about 25% by weight, particularly between about 7% and about 20% by weight, and more particularly between about 8% and about 15% by weight. When preparing the solid detergent composition by casting techniques, water may be present in the ranges of between about 15% and about 50% by weight, particularly between about 20% and about 45% by weight, and more particularly between about 22% and about 40% by weight.

The soaking composition of the present invention includes a binding agent to aid in solidifying the composition and binding the components together. While the actual solidification mechanism occurs through ash hydration, or the interaction of the alkalinity source (e.g., sodium carbonate) with water, it is believed that the binding agent functions to control the kinetics and thermodynamics of the solidification process and provides a solidification matrix in which additional functional materials may be bound to form a functional solid composition. In general, an effective amount of binding agent is considered an amount that effectively controls the kinetics and thermodynamics of the solidification system by controlling the rate and movement of water. An example of a particularly suitable binding agent includes, but is not limited to, sodium citrate.

The soaking composition can include one or more threshold agents, also called chelating or sequestering agents (e.g., builders). Exemplary threshold agents include, but are not limited to: a condensed phosphate, a phosphonate, an aminocarboxylic acid, or a polyacrylate. In addition, when sodium citrate is included in the solid soaking composition, the sodium citrate may also function as a builder. In general, a chelating agent is a molecule capable of coordinating (i.e., binding) the metal ions commonly found in natural water to prevent the metal ions from interfering with the action of the other detersive ingredients of a cleaning composition.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the soaking composition by fixing the free water present in the composition as water of hydration.

Examples of phosphonates include, but are not limited to: 1-hydroxyethane-1, 1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_2$; and phosphorus acid, $H_3PO_3$. A particularly suitable phosphonate includes, but is not limited to, ATMP. A neutralized or alkaline phosphonate, or a combination of the phosphonate with an alkali source prior to being added into the mixture such that there is little or no heat or gas generated by a neutralization reaction when the phosphonate is added is preferred.

The soaking composition can contain a non-phosphorus based threshold agent. Although various components may include trace amounts of phosphorous, a composition that is considered free of phosphorous generally does not include phosphate or phosphonate builder or chelating components as an intentionally added component. Carboxylates such as citrate or gluconate are suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent.

The soaking composition of the present invention is substantially free of phosphorus-containing compounds, making the detergent composition more environmentally acceptable. Phosphorus-free refers to a composition, mixture, or ingredients to which phosphorus-containing compounds are not added. Should phosphorus-containing compounds be present through contamination of a phosphorus-free composition, mixture, or ingredient, the level of phosphorus-containing compounds in the resulting composition is less than approximately 1 wt %, less than approximately 0.5 wt %, less than approximately 0.25 wt % and often less than approximately 0.1 wt %.

Accordingly, soaking compositions which are substantially free of phosphorus (phosphate) and which, in addition, are less corrosive to metal surfaces, do not produce aesthetic defects on metal surfaces, and are low-foaming fall within the scope of the present invention.

Additional Functional Materials

The soaking composition can include additional components or agents, such as additional functional materials. As such, in some embodiments, the soaking composition including the alkalinity source, a metal protector, a surfactant or surfactant system, water, a threshold agent, a binding agent and a polymer blend may provide a large amount, or even all of the total weight of the soaking composition, for example, in embodiments having few or no additional functional materials disposed therein. The functional materials provide desired properties and functionalities to the cleaning composition. For the purpose of this application, the term "functional materials" include a material that when dispersed or dissolved in a use and/or concentrate solution, such as an aqueous solution, provides a beneficial property in a particular use. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in soaking applications, but it should be understood that other embodiments may include functional materials for use in other applications.

Enzymes

Enzymes that can be included in the soaking composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the solid soaking composition is provided as a use composition. Exemplary ranges of the enzyme in the concentrate include up to approximately 15% by weight, between approximately 0.5% to approximately 10% by weight, and between approximately 1% to approximately 5% by weight.

Defoaming Agents

The soaking composition can include a defoaming agent to reduce the stability of foam and reduce foaming. When the concentrate includes a defoaming agent, the defoaming agent can be provided in an amount of between about 0.01 wt. % and about 3 wt. %.

Examples of defoaming agents that can be used in the soaking composition include ethylene oxide/propylene block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

Dyes and Fragrances

Various dyes, odorants including perfumes, and other aesthetic enhancing agents may also be included in the soaking composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), Pylakor Acid Bright Red (Pylam), and the like. Fragrances or perfumes that may be included in the compositions include, for example, terpenoids such as citronellol, aldehydes such as amyl cinnamaldehyde, a jasmine such as C1S-jasmine or jasmal, vanillin, and the like.

Methods of Use

In general, a soaking composition using the components of the present invention can be created by combining a powder premix and a liquid premix and allowing the components to interact and solidify. For example, in a first embodiment, the solid soaking composition may include first mixing the alkalinity source, metal protector and surfactant system to form a powder premix. The water, binding agent, threshold agent and polymer blend are combined to form a liquid premix. The powder and liquid premixes are then combined together to form the soaking composition.

In some embodiments, the relative amounts of powder premix and liquid premix are controlled within a composition. Any additional functional components are then added as the components harden into solid form. As the composition solidifies, the binder binds and solidifies the components. The solidification process may last from a few minutes to about six hours, depending on factors including, but not limited to: the size of the formed or cast composition, the ingredients of the composition, and the temperature of the composition.

The soaking compositions of the present invention are produced using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a soaking composition processed according to the method of the invention is substantially homogeneous with regard to the distribution of ingredients throughout its mass and is dimensionally stable.

Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

Specifically, in a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid form", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the soaking composition under the expected conditions of storage and use of the solid soaking composition. In general, it is expected that the detergent composition will remain in solid form when exposed to temperatures of up to approximately 100° F. and particularly greater than approximately 120° F.

The resulting solid soaking composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the solidification matrix have a weight of approximately 100 grams or greater, and solid block detergents formed by the solidification matrix have a mass of between approximately 1 and approximately 10 kilograms. The soaking compositions provide for a stabilized source of functional materials. In some embodiments, the solid soaking composition may be dissolved, for example, in an aqueous or other medium, to create a concentrated and/or use solution. The solution may be directed to a storage reservoir for later use and/or dilution, or may be applied directly to a point of use.

In certain embodiments, the solid soaking composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet having a size of between approximately 1 gram and approximately 50 grams.

In other embodiments, the soaking composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

Although the soaking composition is discussed as being formed into a solid product, the soaking composition may also be provided in the form of a paste. When the concentrate is provided in the form of a paste, enough water is added to the soaking composition such that complete solidification of the soaking composition is precluded. In addition, dispersants and other components may be incorporated into the soaking composition in order to maintain a desired distribution of components.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Materials Used

The composition of Example 1 is a composition of the present invention. In particular, the composition of Example 1 included component concentrations (in weight percent) of sodium carbonate (soda ash or dense ash), sodium silicate, surfactants, water, sodium citrate, a threshold agent and a polymer blend as shown in Table 1 below. The polymer blend included Belclene 200, Acusol 445N and Acusol 929. The sodium carbonate, sodium silicate and surfactants were premixed to form a powder premix and the water, sodium citrate, threshold agent and polymer blend were premixed to form a liquid premix. The powder premix and the liquid premix were then mixed together to form the composition. The composition of Example 1 was diluted to a concentration of about 3000 ppm.

TABLE 1

| Component | |
|---|---|
| Alkalinity Source, wt. % | 30-80 |
| Metal Protector, wt. % | 15-35 |
| Surfactant, wt. % | 2-10 |
| Water, wt. % | 5-20 |
| Binding Agent, wt. % | 2-8 |
| Threshold Agent, wt. % | 0.2-2 |
| Polymer Blend, wt. % | 0.5-5 |

Dawn Professional, a manual detergent available from Procter and Gamble, Cincinnati, Ohio.

MagFusion, a manual detergent available from Ecolab Inc., St. Paul, Minn.

Cream Suds, a manual detergent and pot and pan soak, available from Procter and Gamble.

Pantastic, a liquid pot and pan detergent available from Ecolab Inc.

Apex Metal Protection, a machine detergent available from Ecolab Inc.

Silver Power, a flatware presoak available from Ecolab Inc., St. Paul, Minn.

Apex Presoak, a flatware presoak available from Ecolab Inc., St. Paul, Minn.

Soil Removal

A plurality of 3×5 inch stainless steel panels were cleaned with soap and water and weighed. One package of Hormel Original Black Label Bacon was ground in a blender until a paste consistency was achieved. A thin layer of approximately 0.7 grams of paste was evenly spread on each panel with a foam brush. The panels were then baked for about one hour and ten minutes at about 440 degrees Fahrenheit (° F.). The panels were then allowed to cool.

Example 1 and Comparative Examples A, B and C

To determine if using a soaking composition before washing ware will reduce the number of times the ware must be washed in a dishmachine to remove soils, a plurality of separate soaking solutions were made in plastic 1000 milliliter (ml) containers. The solutions were then heated to about 130° F. and the panels prepared according to the method above were soaked in one of the soaking solutions for about twenty minutes.

A detergent solution was made and the wash temperature in a dishmachine was allowed to reach about 160° F. and the rinse temperature was allowed to reach about 180° F. After the twenty minute soak time, the panels were run through the dishmachine until no more soil was removed from the panels. The panels were re-soaked and re-washed until all of the soil was removed from the panels. The number of washes required to remove the soil was recorded.

The composition of Comparative Example A included only water. Each of the compositions of Comparative Examples B and C included commercially available manual detergents. In particular, the composition of Comparative Example B included MagFusion and the composition of Comparative Example C included Dawn Professional. A control was also used in which the panels were not soaked and were only run through the dishmachine.

Table 2 shows the number of washes required to completely remove the soil from the panels using each of the soaking solutions of the compositions of Example 1 and Comparative Examples A, B and C. The number of washes required to remove the soil from the control is also shown in Table 2.

TABLE 2

| | Number of Washes |
|---|---|
| Example 1 | 2 |
| Comparative Example A | 8 |
| Comparative Example B | 6 |
| Comparative Example C | 12 |
| Control | 9 |

As illustrated in Table 2, the panels that were soaked in the composition of Example 1 completed removed the soil from the panels after only 2 soaking and washing cycles. When soaked in the composition of Comparative Example A, which included just water, the panels had to be soaked and run through the dishmachine 8 times, or 4 times more than the panels soaked in the composition of Example 1 before all of the soil was removed from the panels.

The panels that were soaked in the composition of Comparative Example B were soaked and run through the dishmachine 6 times before the soil was removed from the surfaces. Thus, the panels soaked in the composition of Comparative Example B had to be soaked and washed 3 times more than the panels soaked in the composition of Example 1 to achieve the same results. The panels soaked in the composition of Comparative Example C had to be soaked and run through the dishmachine 6 times more than the panels soaked in the composition of Example 1 before all of the soil was removed.

The results in Table 2 show that the composition of the present invention is more effective at removing soils than commercially available manual detergents.

Example 1 and Comparative Examples D, E, F, G, H and I

To determine the soil removal properties of various compositions, a plurality of separate soaking solutions were made in plastic 1000 milliliter (ml) containers. The solutions were then heated to about 130° F. Five 3003 aluminum panels prepared according to the method above were then soaked in each of the soaking solutions for about 2 hours at about 120° F. While the panels were soaking, the dishmachine was set up using a detergent solution including 12 drops of T1 MagFusion. The wash temperature of the dishmachine was allowed to reach about 160° F. and the rinse temperature of the dishmachine was allowed to reach about 180° F.

The soil removal properties of the solutions were evaluated on a scale of 1 to 5 based on the appearance of the strips with "1" being the worst rating and "5" being the best rating. An average rating of about 3.5 is considered acceptable.

The composition of Comparative Example D included only water. Each of the compositions of Comparative Examples E-I included commercially available detergents. In particular, the composition of Comparative Example E included 2 times the recommended concentration of Pantastic, the composition of Comparative Example F included 0.27% active Cream Suds and the compositions of Comparative Examples G, H and I included, respectively, 0.08%, 0.27% and 0.4% active Apex Metal Protection. A control was also used in which the panels were not soaked and only run through the dishmachine.

Table 3 shows the ratings for the 3003 aluminum strips soaked in the compositions of Example 1 and soaked in the compositions of Comparative Examples D-I. The ratings of the control are also shown.

TABLE 3

| | Sample 1 | Sample 2 | Sample 3 | Sample 4 | Sample 5 | Average |
|---|---|---|---|---|---|---|
| Example 1 | 4 | 3.5 | 3.5 | 3 | 4.5 | 3.7 |
| Comp. Ex. D | 1 | 1 | 1 | 1 | 1 | 1 |
| Comp. Ex. E | 2 | 2.5 | 3 | 2 | 2 | 2.3 |
| Comp. Ex. F | 1 | 1 | 1 | 1 | 2 | 1.2 |
| Comp. Ex. G | 1 | 2 | 2.5 | 1 | 1 | 1.5 |
| Comp. Ex. H | 1 | 2 | 3 | 2 | 3 | 2.2 |
| Comp. Ex. I | 1 | 2 | 2 | 3 | 3 | 2.2 |
| Control | 1 | 2 | 2 | 1 | 2 | 1.6 |

As illustrated in Table 3, only the composition of the present invention (Example 1) had acceptable soil removal properties with an average soil removal rating of about 3.7. The strips that were not soaked at all (the control) or soaked only in water (Comparative Example D) had average soil removal ratings of less than 2. All of the strips soaked in the compositions of Comparative Examples E-I, commercially available products, had average soil removal ratings of 2.3 or less and did not have acceptable soil removal capability.

The weight loss of each strip was also taken for the aluminum panels. The average percent weight loss of the 5 samples soaked in each of the compositions of Example 1 and Comparative Examples D-I as well as the control are shown below in Table 4.

TABLE 4

| | Weight Loss (%) |
|---|---|
| Example 1 | 86 |
| Comp. Ex. D | 31 |
| Comp. Ex. E | 55 |
| Comp. Ex. F | 53 |
| Comp. Ex. G | 47 |
| Comp. Ex. H | 58 |
| Comp. Ex. I | 63 |
| Control | 44 |

As can be seen in Table 4, the strips soaked in the composition of Example 1 lost the greatest percent of weight, or soil. The strips that were not soaked or soaked only in water (the control and Comparative Example D, respectively) lost less than 50% of their initial weight.

The strips soaked in commercially available pot and pan soaks and manual detergents (Comparative Examples E-I) also did not lose as much weight as the strips soaked in the composition of the present invention. In particular, the strips soaked in the composition of Example 1 had at least a 36.5% greater percent weight loss than the strips soaked in the pot and pan soaks and the manual detergents.

The results in Tables 3 and 4 show that the composition of the present invention is more effective at removing soils than currently available commercial manual detergents and pot and pan soaks.

Example 1 and Comparative Examples J, K and L

To determine the soil removal capabilities of the composition of the present invention compared to other compositions, a plurality of separate soaking solutions were made in plastic 1000 milliliter (ml) containers. The solutions were then heated to about 130° F. Five 3003 aluminum panels prepared according to the method above were then soaked in each one of the soaking solutions for about 2 hours at about 125° F. While the panels were soaking, the dishmachine was set up. A detergent solution including 12 drops of T1 MagFusion was used and the wash temperature was allowed to reach about 160° F. and the rinse temperature was allowed to reach about 180° F.

The soil removal properties of the solutions were evaluated on a scale of 1 to 5 based on the appearance of the strips with "1" being the worst rating and "5" being the best rating. An average rating of about 3.5 is considered acceptable.

The composition of Comparative Example J included water. The composition of Comparative Example K included about 4000 ppm of Silver Power and the composition of Comparative Example L included about 4000 ppm of Apex Presoak.

Table 5 shows the ratings for the 3003 aluminum strips soaked in the compositions of Example 1 and soaked in the compositions of Comparative Examples J, K and L.

TABLE 5

| | Sample 1 | Sample 2 | Sample 3 | Sample 4 | Sample 5 | Average |
|---|---|---|---|---|---|---|
| Example 1 | 4 | 3 | 4 | 3.5 | 3.5 | 3.6 |
| Comp. Ex. J | 1 | 1 | 1 | 1 | 1 | 1 |
| Comp. Ex. K | 2 | 2 | 2 | 2 | 2 | 2 |
| Comp. Ex. L | 3 | 3.5 | 3 | 3.5 | 4 | 3.4 |

As illustrated in Table 5, the composition of the present invention (Example 1) outperformed the compositions of Comparative Example J, K and L at removing soils. As expected, the aluminum strips soaked in the composition of Example 1 had a significantly higher soil removal rating than the strips soaked in the composition of Comparative Example J, which included only water.

In addition, the composition of Example 1 also outperformed the compositions of Comparative Examples K and L, commercially available presoaks, at removing soils. This was true even though the compositions of Comparative Examples K and L included higher concentrations of the detergent than the composition of Example 1.

The results in Table 5 show that the composition of the present invention is more effective at removing soils than currently commercially available detergents.

Metal Protection

Example 1

To determine if carryover from the soaking composition of the present invention prevented aluminum discoloration, a plurality of 3003 and 6061 aluminum panels were cleaned with soap and rinsed with deionized water. A plurality of soaking solutions were prepared using 5 GPG water. A group of 5 aluminum panels were allowed to soak in each of the solutions for about 15 minutes and then run through a dishmachine. The dishmachine included 12 drop T1 MagFusion detergent. The soaking and washing steps were repeated 30 times.

The strips were evaluated as either okay (OK) or no good (NG). The slightest amount of corrosion or discoloration was given an evaluation of NG. Ratings were recorded after 10 soak and wash cycles, after 20 soak and wash cycles and after 30 soak and wash cycles.

A control was used in which the panels were not soaked and only run through the dishmachine.

Table 6 shows the ratings for the 3003 aluminum and 6061 aluminum panels for Example 1 and the control.

TABLE 6

| | Aluminum Type | 10 Washes | 20 Washes | 30 Washes |
|---|---|---|---|---|
| Example 1 | 3003 | OK | OK | OK |
| | 6061 | OK | OK | OK |
| Control | 3003 | NG | NG | NG |
| | 6061 | NG | NG | NG |

As illustrated in Table 6, the aluminum panels that were immersed in the soaking solution of the present invention provided metal protection to both Aluminum 3003 and 6061 panels while the aluminum panels that were not immersed in a soaking solution did not. In particular, after 10, 20 and 30 washes, the aluminum panels that were soaked in the composition of Example 1 did not exhibit any corrosion or discoloration. By contrast, the aluminum panels that were not exposed to the soaking composition of the present invention before washing (the control) showed evidence of corrosion or discoloration after only 10 washes.

The results in Table 6 show that carryover from a soaking composition of the present invention prevents corrosion and/or discoloration on aluminum panels.

Example 1 and Comparative Examples M, N and O

To determine the metal protection carryover from a composition of the present invention and commercially available manual detergents on 3003 aluminum panels, a plurality of 3003 aluminum panels were cleaned with soap and rinsed with deionized water and a plurality of soaking solutions were prepared. Two 3003 aluminum panels were allowed to soak in each of the solutions for about 5 minutes and then run through a dishmachine. The dishmachine included 12 drop T1 MagFusion detergent. The soaking and washing steps were repeated 20 times.

The strips were evaluated as either okay (OK) or no good (NG). The slightest amount of corrosion or discoloration was given an evaluation of NG. Ratings were recorded after 10 soak and wash cycles and after 20 soak and wash cycles.

Each of the compositions of Comparative Examples M, N and O included commercially available products diluted to their recommended levels. The composition of Comparative Example M included a 2 ounce per 10 gallon dilution (1496 ppm) of Dawn Professional, the composition of Comparative Example N included a 1 ounce per 20 gallon dilution (374 ppm) of MagFusion and the composition of Comparative Example O included 2700 pmm of Cream Suds. A first control was used that was not subjected to a soaking step and only run through the dishmachine. A second control was also used that was not subject to a soaking step or run through a dishmachine.

Table 7 shows the ratings for the 3003 aluminum strips soaked in the compositions of Example 1, the aluminum strips soaked in the compositions of Comparative Examples M, N and O and the first aluminum strip control.

TABLE 7

| | 10 Washes | 20 Washes |
|---|---|---|
| Example 1 | OK | OK |
| Comparative Example M | NG | NG |
| Comparative Example N | NG | NG |
| Comparative Example O | NG | NG |
| First Control | NG | NG |

As shown in Table 7, only the aluminum strips that were exposed to the soaking composition of the present invention (Example 1) did not show any corrosion or discoloration after 10 washes or 20 washes. By contrast, aluminum strips that were immersed in the compositions of Comparative Examples M-O also showed corrosion or discoloration after only 10 washes. Similarly, the control strips that were not immersed in any soaking composition and only run through the dishmachine showed corrosion or discoloration after 10 washes.

A whiteness reading was also taken for the aluminum panels after 20 washes. The Hunter Color Meter was used to capture the whiteness of the panels. Generally, the higher the whiteness rating of the strip, the more white, or clean, the strip. The results are shown below in Table 8.

TABLE 8

| | Whiteness Rating |
|---|---|
| Example 1 | 19.3 |
| Comparative Example M | 8.2 |
| Comparative Example N | 8.0 |
| Comparative Example O | 8.5 |
| First Control | 11.8 |
| Second Control | 23 |

Compared to the second control in which the strips were not soaked or washed, the strips exposed to the composition of Example 1 only showed about a 16% decrease in whiteness. By contrast, the strips that were not immersed in any soaking composition but run through the dishmachine (first control) had about a 48.7% decrease in whiteness compared to the strips that were not soaked or washed.

The whiteness ratings of the strips immersed in the compositions of Comparative Examples M, N and O decreased by more than 50% compared to the whiteness rating of controls and of the strips immersed in the soaking composition of the present invention (Example 1).

The results in Tables 7 and 8 show that the soaking composition of the present invention prevents aluminum corrosion and/or discoloration on aluminum panels.

Example 1 and Comparative Examples P, Q, R and S

To determine which components of the present invention are the main drivers for metal protection, a plurality of 3003 aluminum panels were cleaned with soap and rinsed with deionized water and a plurality of soaking solutions were prepared. Two 3003 aluminum panels were allowed to soak in each of the solutions for about 5 minutes and then run through a dishmachine. The dishmachine included 12 drops of T1 MagFusion detergent. The soaking and washing steps were repeated 20 times.

The strips were evaluated as either okay (OK) or no good (NG). The slightest amount of corrosion or discoloration was given an evaluation of NG. Ratings were recorded after 10 soaks and washes and after 20 soaks and washes.

Each of the compositions of Comparative Examples P-S were prepared similarly to the composition of Example 1 except that each of the compositions of Comparative Examples P-S removed at least one component. In particular, the composition of Comparative Example P removed the Tomadol 1-3, the composition of Comparative Example Q removed the Surfonic L24-7, the composition of Comparative Example R removed both the Tomadol and the Surfonic L24-7 and the composition of Comparative Example S removed the polymer blend. A control was also used in which the panels were not soaked and only run through the dishmachine.

Table 9 shows the ratings for the 3003 aluminum panels soaked in the compositions of Example 1 and soaked in the compositions of Comparative Examples P-S. The ratings for the control are also shown.

TABLE 9

| | 10 Washes | 20 Washes |
|---|---|---|
| Example 1 | OK | OK |
| Comparative Example P | OK | OK |
| Comparative Example Q | OK | OK |
| Comparative Example R | OK | NG |
| Comparative Example S | OK | NG |
| Control | NG | NG |

As illustrated in Table 9, the panels that were soaked in the composition of Example 1 did not have any corrosion or discoloration after 10 washes or after 20 washes. By contract, when the panels were not soaked in a soaking composition (the control), they exhibited some corrosion or discoloration after either 10 washes or after 20 washes.

The panels soaked in the compositions of Comparative Examples P and Q did not show any corrosion or discoloration after 10 washes or after 20 washes. Thus, when only one surfactant was removed from the composition of Example 1, the metal protection properties of the soaking composition were not affected.

The panels soaked in compositions in which both surfactants were removed from the composition (Comparative Example R) or in which the polymer blend was removed from the composition (Comparative Example S) showed corrosion or discoloration after about 20 washes.

The data in Table 9 shows that the main drivers for metal protection were the surfactants in combination with each other and the polymer blend. The removal of either both of the surfactants or the polymer blend decreased the metal protection ability of the composition.

Example 1

To determine the aluminum protection of a given detergent, aluminum strips were completely and partially submerged in a given detergent. A water bath was first heated to about 180° F. The strips were then cleaned with acetone and allowed to air dry. About 500 mls of each test solution was then prepared at concentrations of about 0.5%, 0.4%, 0.3%, 0.2% and 0.1% to determine at what level protection fails.

For each solution, enough solution was added to a first bottle to completely cover the strip and added to a second bottle to only cover about half of the strip. Each of the bottles was then covered and placed in a 180° F. water bath and allowed to sit for about six hours. The strips were then rinsed under cold running water, placed on a towel and allowed to air dry.

The composition of Example 1 was tested at both 5 GPG water hardness and 17 GPG water hardness. The results of the testing are shown below in Table 10.

TABLE 10

| | | 0.1% Solution | 0.2% Solution | 0.3% Solution | 0.4% Solution | 0.5% Solution |
|---|---|---|---|---|---|---|
| Example 1 | 5 GPG | Fail | Fail | Pass | Pass | Pass |
| | 17 GPG | Fail | Fail | Pass | Pass | Pass |

As illustrated in Table 10, the compositions of the present invention were only effective when they were diluted to a concentration of at least about 0.3% at both 5 GPG and 17 GPG water hardness. At lower concentrations, the compositions failed to protect the metal strips.

Metal Compatibility

Example 1

To determine the compatibility of the composition of the present invention with various surfaces, a plurality of ware surfaces were first photographed before testing. After the compositions were prepared, the ware was fully immersed in the solutions. The compositions were then placed in a water bath heated to a temperature of about 180° F. for about 24 hours. The ware was removed from the compositions after about 24 hours and rinsed with deionized water. The ware was then allowed to dry. The ware was photographed and compared to the photographs taken before testing to determine if any discoloration or filming occurred. Any change in the ware was considered a failure.

The composition of Example 1 was tested at 5 GPG water hardness diluted to about 8 oz/20 gallons (3000 ppm). The results of the testing are shown below in Table 11. The results of the control, water, are also shown.

TABLE 11

| | Ceramic | Glass | Sterling Silver |
|---|---|---|---|
| Example 1 | Pass | Pass | Pass |
| Control | Pass | Pass | Pass |

As can be seen from the results shown in Table 11, both the composition of the present invention and water did not cause discoloration or filming on ceramic, glass or sterling silver surfaces.

Examples 1 and 2 and Comparative Example T

To determine the compatibility of the composition of the present invention with various surfaces, a plurality of ware surfaces were first photographed before testing. After the compositions were prepared, the ware was fully immersed in the solutions. The compositions were then placed in a water bath heated to a temperature of about 130° F. for about 8 hours. The ware was removed from the compositions after about 8 hours and rinsed with deionized water. The ware was them allowed to dry. The ware was photographed and compared to the photographs taken before testing to determine if any discoloration or filming occurred. Any change in the ware was considered a failure.

The composition of Example 1 was tested at 5 GPG water hardness diluted to about 8 oz/20 gallons (3000 ppm). The composition of Example 2 was tested at 5 GPG water hardness diluted to about 10 oz/20 gallons (4000 ppm).

The composition of Comparative Example T included Apex Manual diluted to about 0.75 oz/20 gallons.

The results of the testing are shown below in Table 12. The results of the control, water, are also shown.

TABLE 12

| | Copper | Pewter | Hard Anodized Aluminum |
|---|---|---|---|
| Example 1 | Pass | Pass | Pass |
| Example 2 | Pass | Pass | Pass |
| Comp. Ex. T | Pass | Fail | Pass |
| Control | Pass | Fail | Pass |

Table 12 illustrates that the composition of the present invention, both at an 8 oz/20 gallon dilution and at a 10 oz/20 gallon dilution did not cause any discoloration or filming on copper, pewter or hard anodized aluminum surfaces. In contrast, the composition of Comparative Example T caused discoloration and/or filming on the pewter surface. The water also caused discoloration and/or filming on the pewter surface.

Glewwe Foam Test

Example 1 and Comparative Example BB

To evaluate the foaming tendency of a rinse additive under simulated dishmachine conditions, the Glewwe foam rinse additive evaluation was performed. The Glewwe apparatus was used to simulate dishmachine pump agitation. A rinse additive was added to the circulating water and the foam generated was measured after one minute and after five minutes. The Glewwe apparatus was first thoroughly rinsed by filling it with city water and running the pump. The apparatus was then drained by opening the gate valve. If foam was generated during the cleaning, the procedure was repeated until no foam was present.

The gate valve was then closed and the top lid was removed. The chimney was filled with hot city water to the base of the ruler. The pump switch was turned on and the temperature was adjusted to about 160° F. by adding either cold or hot city water. The pressure was adjusted to about 6 pounds per square inch (psi) and the pump was stopped. The water level was re-adjusted to the base.

The pump was then turned on and the pressure was allowed to reach about 6 psi. Small aliquots of detergent were added for each one minute mix time. The pump was then stopped and the height of the foam was measured at time zero, after 30 seconds and after 60 seconds. Additional detergent was then added and the foam measured.

The composition of Comparative Example BB included MagFusion.

Table 13 shows the grams of solution, grams of detergent, percent solution and foam height at time zero, after 30 seconds and after 60 seconds.

TABLE 13

| | Solution (g) | Detergent (g) | % Solution | t = 0 | t = 30 sec. | t = 60 sec. |
|---|---|---|---|---|---|---|
| Example 1 | 1.1 | 0.033 | 0.0011 | 0.5 | 0 | 0 |
| | 2.66 | 0.1128 | 0.0038 | 4 | 3 | 3 |
| | 1.04 | 0.144 | 0.0048 | 4.5 | 4 | 3 |
| | 1.04 | 0.1752 | 0.0058 | 5 | 4 | 4 |
| | 1.04 | 0.2064 | 0.0069 | 5.5 | 4.5 | 4 |
| | 1.02 | 0.237 | 0.0079 | 6.5 | 6 | 5 |

TABLE 13-continued

| | Solution (g) | Detergent (g) | % Solution | t = 0 | t = 30 sec. | t = 60 sec. |
|---|---|---|---|---|---|---|
| Comp. | 1 | 0.0028 | 0.0001 | 0.5 | 0 | 0 |
| Example | 2.54 | 0.0100 | 0.0003 | 3 | 2 | 1.5 |
| BB | 1.17 | 0.0132 | 0.0004 | 5 | 3 | 2.5 |
| | 1.12 | 0.0164 | 0.0005 | 7.5 | 5 | 4.5 |
| | 1.16 | 0.0197 | 0.0007 | 8.5 | 7.5 | 6.5 |

As can be seen from Table 13, even at nearly ten times higher concentration, the detergent composition of Example 1 exhibited either substantially similar or lower foaming tendencies than the composition of Comparative Example BB. After about 60 seconds, the composition of Example 1 had about a 3 inch foam at a concentration of about 0.0048 while the composition of Comparative Example BB had about a 2.5 inch foam at a concentration of about 0.0005. After about 60 seconds, the composition of Example 1 had about a 4 inch foam at a concentration of about 0.0069 while the composition of Comparative Example BB had about a 6.5 inch foam at a concentration of about 0.0007.

Chelation Test

To evaluate the chelating ability of various compositions, a plurality of 700 ml beakers were first washed with soap and water and then rinsed with deionized water. After the beakers were allowed to dry, various compositions were prepared at about 120° F. using 17 GPG water and poured into respective beakers. The beakers were then placed in an oven heated to about 120° F. for about 24 hours. After the beakers were removed from the oven, the compositions were poured from the beakers and the beakers were rinsed with deionized water. The beakers were then allowed to dry.

Examples 3, 4, 5, 6, 7, 8, 9, 10 and 11

The compositions of Examples 3, 4, 5, 6, 7, 8, 9, 10 and 11 included varying polymer blend ratios of Acusol 445N, Acusol 929 and Belclene 200. The compositions of Examples 3-11 also included the same component concentrations of dense ash, sodium silicate, surfactant, water sodium citrate, sodium hydroxide, ATMP and dye.

Table 14 provides a summary of the polymer blend ratios and resulting appearance of the beakers.

TABLE 14

| | Belclene 200 (wt %) | Acusol 445N (wt %) | Acusol 929 (wt %) | Ratio of Belclene 200:Acusol 445N:Acusol 929 | Result |
|---|---|---|---|---|---|
| Example 3 | 2.58 | 0.65 | 0.65 | 4:1:1 | Pass, no film buildup |
| Example 4 | 0.65 | 2.58 | 0.65 | 1:4:1 | Pass, no film buildup |
| Example 5 | 0.65 | 0.65 | 2.58 | 1:1:4 | Pass, no film buildup |
| Example 6 | 1.94 | 1.29 | 0.65 | 3:2:1 | Pass, no film buildup |
| Example 7 | 1.29 | 1.94 | 0.65 | 2:3:1 | Pass, no film buildup |
| Example 8 | 1.29 | 0.65 | 1.94 | 2:1:3 | Pass, no film buildup |
| Example 9 | 1.94 | 0.65 | 1.29 | 3:1:2 | Pass, no film buildup |
| Example 10 | 0.65 | 1.94 | 1.29 | 1:3:2 | Pass, no film buildup |
| Example 11 | 0.65 | 1.29 | 1.94 | 1:2:3 | Pass, no film buildup |

As can be seen by the results in Table 14, the ratio of the polymers is not restricted to 1:1:1. As long as there were all three polymers in the compositions, the beakers did not have film buildup. This was true when the ratio was between 4:1:1 and 1:1:4 of the Belclene 200, Acusol 445N and Acusol 929. This was also true when the ratio of Belclene 200, Acusol 445N and Acusol 929 was between 3:2:1 and 1:2:3.

Example 12 and Comparative Examples U, V, W, X, Y, Z and AA

Lime-A-Way, available from Ecolab, St. Paul, Minn., was poured into the beakers to the 200 ml mark. The Lime-A-Way was then swirled in the beakers so that all sides of the beaker came into contact with the Lime-A-Way. The beakers were then filled the rest of the way with 5 GPG hot water and allowed to sit in the beakers for about 5 minutes. The solution was then poured out of the beaker and the beaker was rinsed with deionized water. The beakers were then allowed to dry.

The beakers were rated on a scale from 0 to 5. A 5 indicated that the beaker was nearly perfectly clear, or good, and a 0 indicated that the beaker was majoratively opaque, or bad. The beakers were rated at two different times. Once before the Lime-A-Way was applied and once after the Lime-A-Way was applied. The Lime-A-Way was added because there were two main types of scale that are present in this test. The first scale was a calcium or magnesium carbonate scale, which can be removed by Lime-A-Way, and a magnesium silicate film that cannot be removed by Lime-A-Way. The pre-Lime-A-Way ratings were for both the calcium or magnesium carbonate scale and the magnesium silicate scale. The post Lime-A-Way ratings were only for the magnesium silicate film as the Lime-A-Way wash removed all of the calcium and magnesium carbonate scale. The test determined whether the polymers work in combination to prevent the calcium and magnesium carbonate scale and the magnesium silicate scale from forming.

The composition of Example 12 included the polymer blend in a 1:1:1 ratio.

The compositions of the comparative examples were prepared similarly to the composition of Example 3 except that the comparative examples included only two polymers, only one polymer, or no polymers. However, all other component concentrations remained the same. In particular, the composition of Comparative Example U included Acusol 445N and Acusol 929 at a 1:1 ratio, the composition of Comparative Example V included Belclene 200 and Acusol 929 at a 1:1 ratio, the composition of Comparative Example W included Belclene 200 and Acusol 445N at a 1:1 ratio, the composition of Comparative Example X included only Belclene 200, the composition of Comparative Example Y included only Acusol 445N, the composition of Comparative Example Z included only Acusol 929 and the composition of Comparative Example AA did not include any of the polymers.

Table 15 provides a summary of the polymer blend ratios. Because Comparative Example AA did not include any polymers, the composition included more dense ash to bring the total component concentrations to 100%. Table 15 also provides the ratings before and after the addition of the Lime-A-Way.

TABLE 15

| | Belclene 200 (wt %) | Acusol 445N (wt %) | Acusol 929 (wt %) | Rating Before Lime-A-Way | Rating After Lime-A-Way |
|---|---|---|---|---|---|
| Example 12 | 1.29 | 1.29 | 1.29 | 4 | 4.5 |
| Comp. Example U | — | 1.94 | 1.94 | 2 | 3.5 |
| Comp. Example V | 1.94 | 0.00 | 1.94 | 1 | 3.5 |
| Comp. Example W | 1.94 | 1.94 | 0.00 | 2 | 4 |
| Comp. Example X | 3.87 | 0.00 | — | 2 | 3.5 |
| Comp. Example Y | — | 3.87 | 0.00 | 2.5 | 3 |
| Comp. Example Z | — | — | 3.87 | 3.5 | 3.5 |
| Comp. Example AA | — | — | — | 0.5 | 3.5 |

As can be seen from the data in Table 15, the beakers treated with the composition of Example 12, which was the only composition that included all three polymers, had the highest ratings. When either only two polymers were included in the composition (Comparative Examples U, V and W) or only one polymer was included in the composition (Comparative Examples X, Y and Z), the ratings after the beakers were exposed to the Lime-A-Way were not as high. When the composition did not include any of the polymers (Comparative Example AA), the composition performed substantially similarly to the compositions including only one or two of the polymers.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

We claim:

1. A method of removing heavily soiled surfaces from a substrate, the method comprising:

(a) forming a composition having degreasing and metal protecting properties, the composition consisting of:

(i) about 30 wt. % to about 80 wt. % alkalinity source;

(ii) about 15 wt. % to about 35 wt. % metal protector;

(iii) about 2 wt. % to about 10 wt. % surfactant, wherein the surfactant is an alcohol ethoxylate consisting of a $C_{11}$ linear alcohol with 3 moles ethylene oxide and a 7 mole ethoxylate of a linear, primary $C_{12-14}$ alcohol;

(iv) about 5 wt. % to about 20 wt. % water;

(v) about 0.2 wt. % to about 2 wt. % threshold agent; and (vi) about 2 wt. % to about 8 wt. % polymer blend that functions as a binding agent and a hard water modifier, wherein the polymer blend consists of about 0.5 wt. % to about 5 wt. % each of polymaleic acid and sodium polyacrylate, and wherein the polymaleic acid and sodium polyacrylate are present at a ratio of about 1:1;

(b) removing heavily soiled surfaces from the substrate by contacting the surface of the substrate with the composition.

2. The method of claim 1, wherein the composition has a concentration of at least about 3000 ppm.

3. The method of claim 1, wherein the composition is a solid.

4. The method of claim 1, further comprising diluting the composition.

* * * * *